US009068529B2

(12) United States Patent
Linke

(10) Patent No.: US 9,068,529 B2
(45) Date of Patent: Jun. 30, 2015

(54) PISTON FOR AN INTERNAL COMBUSTION ENGINE

(71) Applicant: MAHLE International GmbH, Stuttgart (DE)

(72) Inventor: Timo Linke, Stuttgart (DE)

(73) Assignee: MAHLE International GmbH, Stuttgart (DE)

( * ) Notice: Subject to any disclaimer, the term of this patent is extended or adjusted under 35 U.S.C. 154(b) by 0 days.

(21) Appl. No.: 14/360,404

(22) PCT Filed: Nov. 26, 2012

(86) PCT No.: PCT/DE2012/001125
§ 371 (c)(1),
(2) Date: May 23, 2014

(87) PCT Pub. No.: WO2013/075700
PCT Pub. Date: May 30, 2013

(65) Prior Publication Data

US 2014/0352647 A1 Dec. 4, 2014

(30) Foreign Application Priority Data

Nov. 26, 2011 (DE) ..... 10 2011 119 525

(51) Int. Cl.
*F02F 3/00* (2006.01)
*F02F 3/16* (2006.01)
(Continued)

(52) U.S. Cl.
CPC ... *F02F 3/16* (2013.01); *F02F 3/20* (2013.01); *F02F 3/225* (2013.01); *F02F 3/22* (2013.01)

(58) Field of Classification Search
CPC ..... F02F 3/16; F02F 3/225; F02F 3/20; F02F 3/22
USPC ..... 123/193.6
See application file for complete search history.

(56) References Cited

U.S. PATENT DOCUMENTS 1,764,465 A 6/1930 Nute
4,056,044 A * 11/1977 Kamman et al. ..... 92/159
(Continued)

FOREIGN PATENT DOCUMENTS

DE 10 2004 019 010 A1 11/2005
DE 10 2004 061 777 A1 8/2006
(Continued)

OTHER PUBLICATIONS

International Search Report of PCT/DE2012/001125, mailed Apr. 16, 2013.
(Continued)

*Primary Examiner* — Hung Q Nguyen
*Assistant Examiner* — James Kim
(74) *Attorney, Agent, or Firm* — Collard & Roe, P.C.

(57) ABSTRACT

The invention relates to a piston (10, 110) for an internal combustion engine. Said piston comprises a piston head (11), a piston skirt (12) and a peripheral recess (24) between the piston head (11) and the piston skirt (12), an annular peripheral cooling channel (17), which is open towards the bottom and which is closed by a closing element (18), being provided in the piston head (11), and the piston skirt (12) having fillets (21) which are connected to the bottom of the piston skirt (11) and interconnected via bearing surfaces (23, 123). According to the invention, at least one projection (26, 126) is formed in the region of a free end face (25, 125) of the bearing surfaces (23, 123) and extends radially into a region of the cooling channel (17), said projection matching an opening (19) in the closing element (18) of the cooling channel (17).

10 Claims, 2 Drawing Sheets

Figure 1:
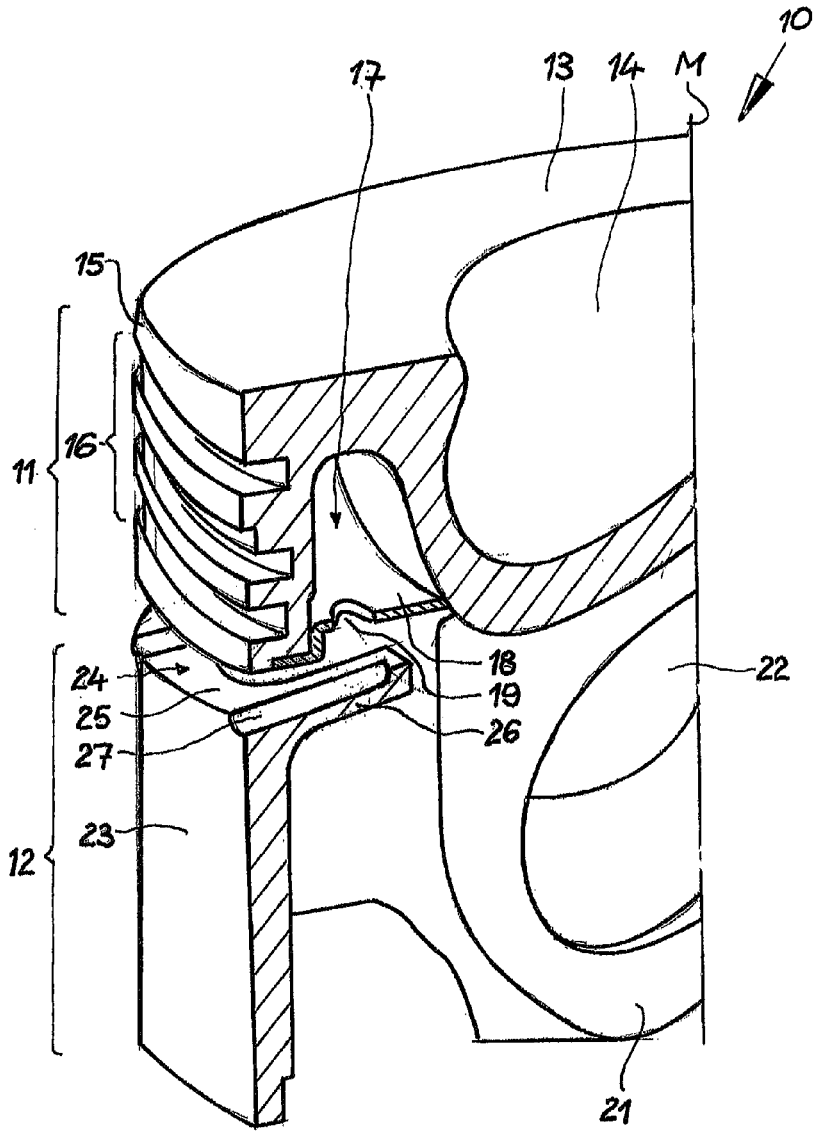

(51) Int. Cl.
*F02F 3/20* (2006.01)
*F02F 3/22* (2006.01)

(56) References Cited

U.S. PATENT DOCUMENTS

| | | | | | |
|---|---|---|---|---|---|
| 4,129,108 | A * | 12/1978 | Elsbett et al. | 123/193.6 |
| 4,286,505 | A * | 9/1981 | Amdall | 92/186 |
| 4,593,660 | A | 6/1986 | Elsbett et al. | |
| 5,065,706 | A * | 11/1991 | Zvonkovic | 123/41.35 |
| 7,578,229 | B2 * | 8/2009 | Dye | 92/186 |
| 7,730,828 | B2 | 6/2010 | Ottliczky et al. | |
| 2003/0188633 | A1 * | 10/2003 | Griffiths et al. | 92/208 |
| 2005/0072394 | A1 * | 4/2005 | Gabriel et al. | 123/193.6 |
| 2008/0121204 | A1 * | 5/2008 | Scharp | 123/193.6 |
| 2011/0197845 | A1 | 8/2011 | Flowers et al. | |
| 2012/0222644 | A1 * | 9/2012 | Bing et al. | 123/193.6 |
| 2013/0032104 | A1 * | 2/2013 | Andreas | 123/41.35 |

FOREIGN PATENT DOCUMENTS

| | | | |
|---|---|---|---|
| DE | 10 2006 015 585 | A1 | 10/2007 |
| EP | 0 106 935 | A1 | 5/1984 |
| GB | 2 431 218 | A | 4/2007 |
| JP | H02-87944 | U | 7/1990 |
| WO | 90/04094 | A1 | 4/1990 |
| WO | 2011/101141 | A1 | 8/2011 |

OTHER PUBLICATIONS

German Search Report dated Aug. 21, 2012 in German Application No. 10 2011 119 525.8, with English translation of the relevant parts of same.

* cited by examiner

PISTON FOR AN INTERNAL COMBUSTION ENGINE

CROSS REFERENCE TO RELATED APPLICATIONS

This application is the National Stage of PCT/DE2012/001125 filed on Nov. 26, 2012, which claims priority under 35 U.S.C. §119 of German Application No, 10 2011 119 525.8 filed Nov. 26, 2011. The international application under PCT article 21(2) was not published in English.

The present invention relates to a piston for an internal combustion engine, having a piston head, a piston skirt, and a circumferential recess formed between the piston head and the piston skirt, wherein a ring-shaped, circumferential cooling channel open toward the bottom and closed off with a closure element is formed in the piston head, wherein the piston skirt has pin bosses connected on the underside of the piston head, which are connected with one another by way of working surfaces.

Such pistons are also referred to as "pistons having a thermally uncoupled piston skirt" and are characterized by great strength and, on the basis of the thermal uncoupling of piston head and piston skirt, by great heat resistance. With regard to modern internal combustion engines, an aim is to optimize the lubrication of the piston in the region of its working surfaces.

A piston of the stated type is known from U.S. Pat. No. 1,764,465 A, for example. To support the lubrication in the region of the working surfaces, a circumferential groove is provided below the piston head, into which groove oil collection pockets empty, which pockets take up lubricant oil when the engine is at rest and give it off again, in the direction of the working surface, when the engine is started again. Such a concept cannot be implemented in modern pistons.

The task of the present invention consists in making available a piston of the stated type, in which the lubrication in the region of the working surfaces is optimized.

The solution consists in that at least one projection that extends radially all the way into a region of the cooling channel is formed in the region of a free face surface of the working surfaces, which projection corresponds with at least one opening in the closure element of the cooling channel.

The idea according to the invention therefore consists in guiding the cooling oil that exits from the cooling channel, through at least one opening in the closure element, in the direction of the working surfaces, in targeted manner, during engine operation, and in this way optimizing the lubrication in the region of the working surfaces. For this purpose, at least one projection is provided along the free face surface of the working surface, which projection extends radially so far into the region below the cooling channel so that the cooling oil exiting from the cooling channel is collected. The cooling oil collected in this manner flows along the projection in the direction of the working surface and there supports the lubrication between the working surface and the corresponding cylinder working surface. The at least one projection, according to the invention, can be implemented in simple manner during the course of the production process for the piston, for example by means of casting in a suitable mold or by means of a forging method.

Advantageous further developments are evident from the dependent claims.

Preferably, the at least one projection can be configured to be inclined in the direction of the piston head, in order to facilitate outflow of the cooling oil exiting from the cooling channel in the direction of the working surfaces. For the same purpose, the at least one projection can instead or additionally have a drain groove that empties into the working surface.

It is practical if multiple projections disposed distributed over the circumference of the working surface are provided, in order to guarantee optimal utilization of the cooling oil exiting from the cooling channel for supplemental lubrication in the region of the working surfaces.

The projection provided according to the invention can also be configured as a one-piece projection that extends over the region of the entire face surface of a working surface, in segments. In this case, the projection can have a collection groove that runs essentially parallel to the working surface, into which groove at least one drain groove that empties into the working surface empties. An alternative embodiment can consist in that the projection has a recess that extends essentially over the entire projection, serves as an oil collection and drain surface, and empties into the working surfaces. In the case of this embodiment, in particular, it is advantageous if the recess is configured as a slanted plane inclined downward in the direction of the working surfaces, in order to guide the cooling oil exiting from the cooling channel reliably in the direction of the working surfaces.

The piston according to the invention is preferably produced at least in part by means of a forging method, and can be configured as a one-part or multi-part piston.

Figure 2:
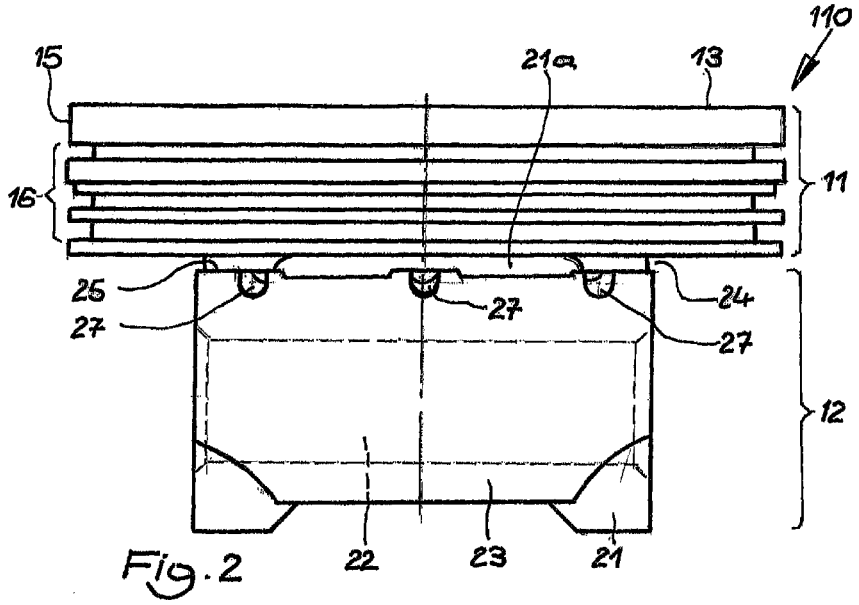
Figure 3:
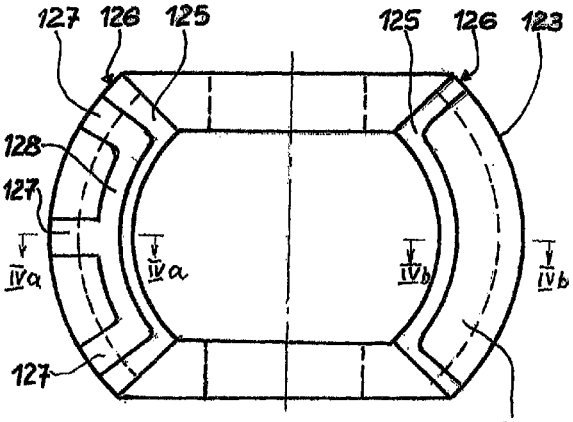
Figures 4A, 4B:
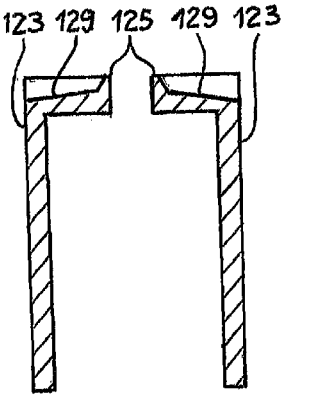

Exemplary embodiments of the present invention will be explained in greater detail below, using the attached drawings. These show, in a schematic representation, not true to scale:

FIG. 1 a first exemplary embodiment of a piston according to the invention, in a perspective, partially sectional representation;

FIG. 2 a front view of the piston according to FIG. 1;

FIG. 3 a top view of two further exemplary embodiments of a piston according to the invention, in a combined representation;

FIG. 4*a* a section along line IVa-IVa in the left side of FIG. 3; and

FIG. 4*b* a section along line IVb-IVb in the right side of FIG. 3.

FIGS. 1 and 2 show a first exemplary embodiment of a piston 10 according to the invention. In the exemplary embodiment, the piston 10 is a one-part piston and has a piston head 11 and a piston skirt 12.

The piston head 11 has a piston crown 13 having a combustion bowl 14 as well as a circumferential top land 15 and a circumferential ring belt 16 for accommodation of piston rings (not shown). Furthermore, a circumferential cooling channel 17, open toward the bottom, is formed between the combustion bowl 14 and the ring belt 16, which channel is closed off, in known manner, with a closure element 18. The closure element 18, for example a circumferential one-part or multi-part spring plate, has at least one opening 19.

The piston skirt 12 has pin bosses 21, in known manner, which are connected with the underside of the piston head 11 by way of pin boss connections 21*a*. The pin bosses 21 are provided with pin bores 22 for accommodation of a piston pin (not shown). The pin bosses 21 are connected with one another in known manner, by way of working surfaces 23.

The piston head 11 is separated from the piston skirt 12 and thereby from the working surfaces 23 by means of a circumferential, ring-shaped recess 24. Thus, the piston head 11 is thermally uncoupled from the piston skirt 12.

According to the invention, separate projections 26 are configured in the exemplary embodiment shown in FIGS. 1 and 2, in the region of the free face surface 25 of the working surfaces 23, which projections are uniformly distributed over the working surfaces 23 in the exemplary embodiment (see FIG. 2). The projections 26 extend radially in the direction of the center piston axis M below the cooling channel 17. The projections 26 project so far into the region below the cooling channel 17, in each instance, that they correspond with an opening 19 in the closure element 18 of the cooling channel 17, in each instance. The cooling oil that exits from the cooling channel 17 through the openings 19 during engine operation drips onto the projections 26 and runs off in the direction of the working surfaces 23, so that it wets the latter and supports the lubrication of the working surfaces 23 during engine operation.

In order to guide the cooling oil in the direction of the working surfaces 23, in targeted manner, drain grooves 27 are formed in the projections 26 in the exemplary embodiment, which grooves empty into the working surfaces 23. The cooling oil collects in the drain grooves 27 and is guided in the direction of the working surfaces 23. Instead or additionally, the projections 26 can be configured to be inclined upward in the direction of the piston head 11, in such a manner that the cooling oil is guided onto a slanted plane in the direction of the working surfaces.

FIGS. 3 and 4 show two further exemplary embodiments of a piston 110 according to the invention, in a detail view, in each instance. In this connection, the two exemplary embodiments are shown in combination in FIG. 3, on the left and right side, respectively.

The essential difference from the exemplary embodiment shown in FIGS. 1 and 2 consists in that in the two exemplary embodiments according to FIGS. 3 and 4, instead of multiple separate projections only a single one-part projection 126 is provided, which extends over the region of the entire face surface 125 of a working surface 123, in the form of a circle segment.

In the exemplary embodiment shown on the left side of FIG. 3, the projection 126 has a collection groove 128 that runs essentially parallel to the working surface 123, which groove extends essentially over the entire length of the face surface 125. In this exemplary embodiment, three drain grooves 127, which in turn empty into the working surfaces 123, empty into the collection groove 128. In this exemplary embodiment, the cooling oil that exits from the cooling channel 17 during engine operation collects in the collection groove 128 and is guided from there into the drain grooves 127 and thereby in the direction of the working surfaces 123.

In the exemplary embodiment shown on the right side of FIG. 3, the projection 126 has a recess 129 that serves as an oil collection and drain surface and empties into the working surfaces 123. In this exemplary embodiment, the cooling oil that exits from the cooling channel 17 during engine operation collects in the recess 129 and is guided from there in the direction of the working surfaces 123. Here, it is particularly advantageous if the projection 126 is configured to be inclined upward in the direction of the piston head 11, in such a manner that the cooling oil is guided on a slanted plane in the direction of the working surfaces 123. Alternatively to this, the recess 129 itself can be configured as a slanted plane inclined downward in the direction of the working surfaces 123, as shown in FIG. 4, in order to guide the collected cooling oil in the direction of the working surfaces 123, in targeted manner.

The invention claimed is:

1. Piston (10, 110) for an internal combustion engine, having a piston head (11), a piston skirt (12), and a circumferential recess (24) formed between the piston head (11) and the piston skirt (12), wherein a ring-shaped, circumferential cooling channel (17) open toward the bottom and closed off with a closure element (18) having at least one opening (19) is formed in the piston head (11), wherein the piston skirt (12) has pin bosses (21) connected on the underside of the piston head (11), which are connected with one another by way of working surfaces (23, 123), wherein at least one projection (26, 126) that extends radially into a region below the cooling channel (17) is formed in the region of a free face surface (25, 125) of the working surfaces (23, 123), wherein said at least one projection corresponds with the at least one opening (19) in the closure element (18) of the cooling channel (17), so that cooling oil exiting from the cooling channel is guided by said at least one projection toward the working surfaces.

2. Piston according to claim 1, wherein the at least one projection (26, 126) is configured to be inclined in the direction of the piston head (11).

3. Piston according to claim 1, wherein the at least one projection (26, 126) has a drain groove (27, 127) that empties into the working surface (23, 123).

4. Piston according to claim 1, wherein multiple projections (26) disposed distributed over the circumference of the working surface (23) are formed.

5. Piston according to claim 1, wherein the projection (126) is configured as a one-part projection (126) that extends over the region of the entire face surface (125) of one of the working surfaces (123).

6. Piston according to claim 5, wherein the projection (126) has a collection groove (128) that runs essentially parallel to the working surface (123), into which at least one drain groove (127) that empties into the working surface empties.

7. Piston according to claim 5, wherein the projection (126) has a recess (129) that serves as an oil collection and drain surface extending essentially over the entire projection (126) and emptying into the working surfaces (123).

8. Piston according to claim 7, wherein the recess (129) is configured as a slanted plane inclined downward in the direction of the working surfaces (123).

9. Piston according to claim 1, wherein it is produced, at least in part, by means of a forging method.

10. Piston according to claim 1, wherein it is configured as a one-part or multi-part piston (10, 110).

* * * * *